United States Patent [19]

Graybeal

[11] 4,030,851

[45] June 21, 1977

[54] MANHOLE CLOSURE INCLUDING A TWO-WAY PRESSURE RELIEF VALVE

[76] Inventor: Walter C. Graybeal, 2100 N. 61st Ave., Hollywood, Fla. 33024

[22] Filed: Nov. 3, 1976

[21] Appl. No.: 738,522

[52] U.S. Cl. ..... 404/25; 52/21; 210/163

[51] Int. Cl.[2] ..... E02D 29/14

[58] Field of Search ..... 404/25, 26; 210/163; 52/24, 20

[56] References Cited

UNITED STATES PATENTS

| | | | |
|---|---|---|---|
| 606,554 | 6/1898 | Jacobs | 404/25 X |
| 3,712,009 | 1/1973 | Campagna | 404/25 X |
| 3,973,856 | 8/1976 | Gaglioti | 404/25 |

*Primary Examiner*—Nile C. Byers
*Attorney, Agent, or Firm*—Malin & Haley

[57] ABSTRACT

A manhole closure for diverting liquid away from a sewer system that is readily installable in a conventional manhole opening beneath a manhole cover, the device including two-way pressure relief valves to compensate for increased or decreased system pressure (relative to atmospheric) within the manhole system while preventing excessive amounts of rainwater and the like, chemical spills or other undesirable pollutants from entering the sanitary sewer system. The two-way valve system includes upper and lower counterweighted flapper valves which sealably cover passages within the closure housing. A valve supporting plate is enclosed in a cylindrical housing and includes upper and lower strainers, the housing being readily mountable in a conventional manhole opening by a rigid supporting rim affixed to the housing. The device will divert liquid flow away from a sanitary sewerage system while preventing over or under gas pressure conditions from developing within the system.

9 Claims, 3 Drawing Figures

Fig. 1.
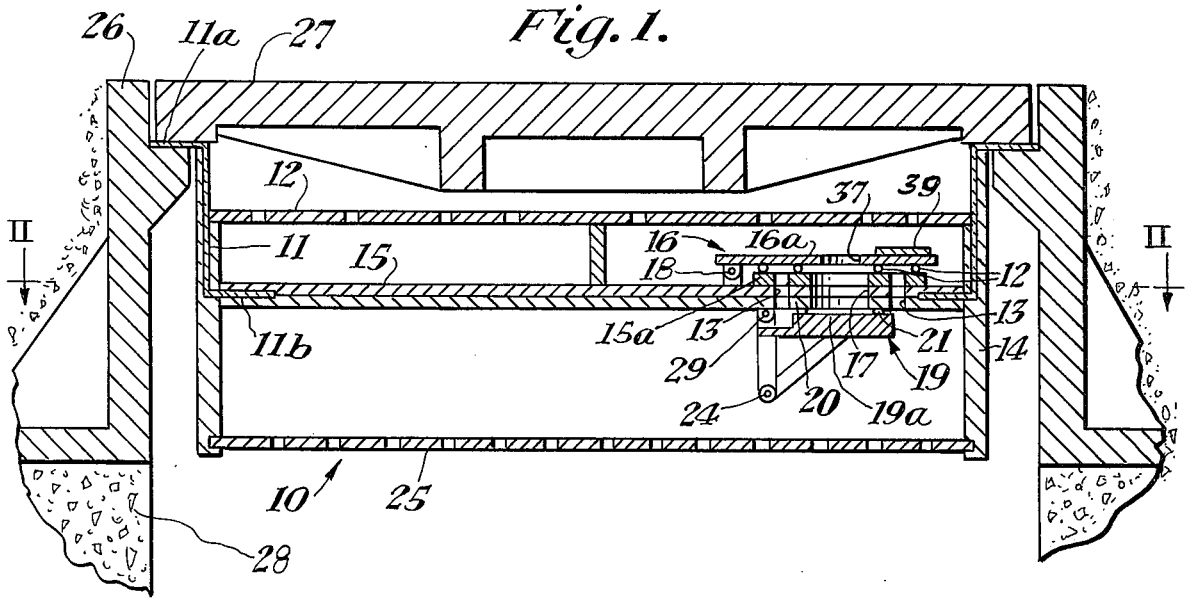
Fig. 2.
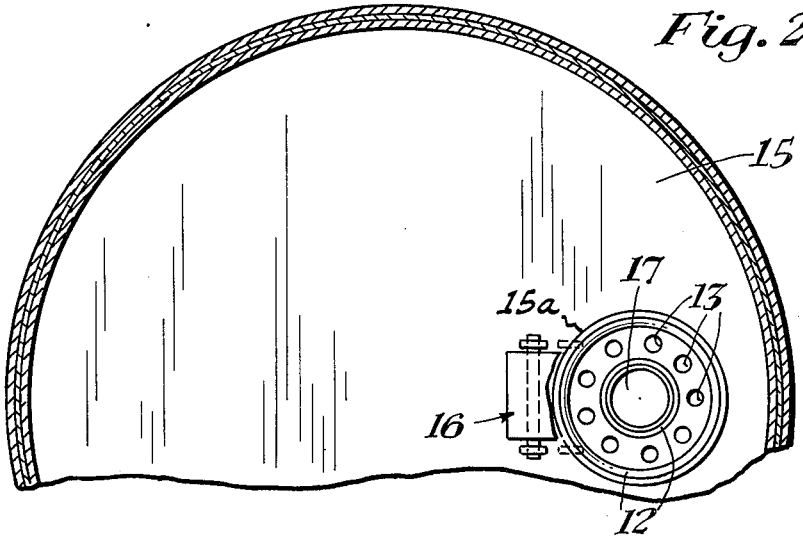
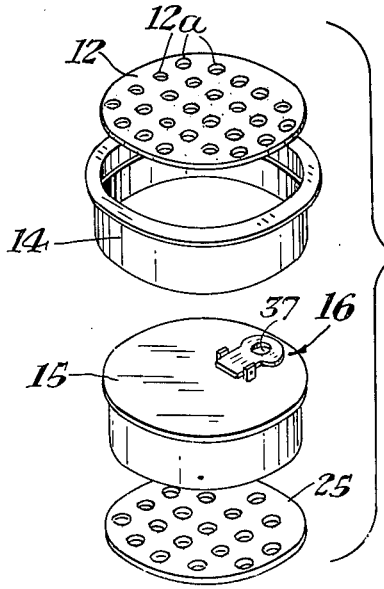
Fig. 3.

MANHOLE CLOSURE INCLUDING A TWO-WAY PRESSURE RELIEF VALVE

BACKGROUND OF THE INVENTION

This invention relates generally to a manhole closure, and specifically to a manhole closure that is readily installable in a conventional manhole opening, the improved closure including a two-way pressure relief valve.

Today's suburban sprawl has created a situation of more paved areas and less impervious areas for normal rainfall to dissipate into the soil. As a result, large amounts of surface runoff water seeps through the conventional sanitary sewer manhole cover vent holes. Thus, surface water entering the sewer system becomes contaminated and must be treated before disposal.

Waste treatment plants are designed with surplus capacity to handle peak load conditions. Depending on area location this capacity can be as high as 40% of the total plant capacity.

Not only will the present invention help keep one of our most precious natural resources from becoming contaminated, but it will also allow the existing waste treatment plants to use that portion of the plant for waste treatment that is normally provided to handle this infiltration. With the existing plants being able to treat a larger load of waste, less new facilities will be required.

To those familiar with the art of waste treatment, additional benefits will become apparent through less energy consumption, less equipment maintenance, less chance of detrimental environmental impact through a more positive treatment control.

The economical advantages of the instant invention in addition to the above benefits, is its long life expectancy. Since it is mounted below a conventional manhole cover, it may be primarily constructed of a plastic type material.

To install the invention, no change is required to the manhole, manhole frame, or manhole cover, the invention being adaptable to existing facilities as well as construction with no additional special tooling or skilled labor to accomplish this function.

BRIEF DESCRIPTION OF THE INVENTION

A manhole closure liquid diverting device adapted to be mounted in a conventional manhole opening beneath a manhole cover comprising a cylindrical housing, said housing having a rigid manhole opening mounting rim connected thereto, a central housing disc mounted inside said housing having a pair of pressure relief valves mounted therethrough, and upper and lower strainer discs disposed near the upper and lower ends of said cylindrical housing. The rigid mounting rim is sized to fit on the horizontal annular lip surface of the conventional manhole opening and is engaged in operation between the manhole cover peripheral edge and the manhole opening annular lip. This holds the device firmly in place within the manhole opening.

The housing body, central disc and disc strainers may be constructed of a durable and hard plastic like material, while the supporting rim is constructed of a light gauge steel.

The device includes upper and lower hinged flapper valves which act to regulate the gaseous pressure within the manhole system, while diverting water flow caused by area runoff away from the sewer system.

The upper flapper valve prevents pressure build-up within the system which may be caused by system liquid filling, gaseous decomposition or both.

The lower flapper valve allows for atmospheric flow into the system should a vacuum develop in the manhole system which could be caused from a receding volume of liquid within the system itself. The valve mechanism is explained in greater detail below.

The cylindrical housing includes a rigid planar shaped disc disposed within the cylinder housing, the disc having a plurality of passageways which allow for pressure atmospheric venting, the passageways being used in conjunction with hinged upper and lower flapper valves which act as the pressure relieving valve system. The upper flapper valve is mounted on the upper surface of the housing disc and has a hinged portion and a weight in conjunction with a sealing means disposed around first and second passageways through the housing disc. A pre-determined amount of pressure within the manhole system will lift the upper flapper valve, the pressure being dependent upon the weight and moment arm of the valve itself. The upper valve also includes an aperture which is aligned with a second passage through the housing disc which is closed on the lower side of the plate by the lower flapper valve which is likewise counterweighted. The lower valve body has a closure surface and a hinge arm, the closure surface being sealed around the second passageway which is in communication with the aperture in the first valve body. The lower valve is held up against the housing disc in the closed position by a counterweight but may be opened by a pressure vacuum in the sewerage system which acts to pull downwardly on the lower-valve while atmospheric pressure will force the lower valve open at a pre-determined vacuum pressure differential dependent upon the counterweight size and moment arm. Upper and lower disc-shaped strainers act to prevent deleterious material from being received into either the valving mechanism or the sewer itself. The strainers are plastic discs having a plurality of apertures in them, the apertures being sized to collect particular materials anticipated in the environment of the manhole.

To install the device, the conventional manhole cover is removed. The improved closure of the instant invention is inserted and supported upon its peripheral annular rim which rests on the upper lip of the manhole opening. The conventional cover is then reinstalled such that the cover pressing against the closure rim holds the closure firmly in position.

In operation, the upper and lower pressure relief valves are counter weighted in a closed position. Thus, any liquids such as rainwater, fire hydrant water, chemical spillages, or any other liquids which are received into the manhole cover will fill up the upper portion of the cylindrical housing of the closure, the device preventing any flow of liquid into the sewerage system. However, the upper valve can operate to relieve excess pressure buildup above atmospheric within the sewer system by functioning regardless of surrounding liquids. Likewise the lower valve can be opened to relieve a vacuum within the sewerage system which will also return to a closed position once the vacuum condition is released.

The upper strainer attached to the housing is a removable circular disc with holes of sufficient area to approximate the holes in the bottom strainer. The location of the holes or apertures in the strainer disc are such that any water that is present in the housing above the strainer does not apply direct force to the upper disc. The upper disc strainer also acts as a stop and limits the travel of the upper hinged flapper valve in its open position.

It is an object of this invention to provide an improved manhole closure to prevent excess water from seeping into the sewerage system.

It is another object of this invention to provide a manhole closure having a cooperating pressure relief valve that is non-complex in construction, reliable and efficient in operation, and of reduced cost.

But yet still another object of this invention is to provide an improved, readily adaptable, easily installed manhole closure that may be adapted to a conventional manhole opening without additional fabrication or installation construction of the manhole opening.

In accordance with these and other objects which will be apparent hereinafter, the instant invention will now be described with particular reference to the accompanying drawings.

BRIEF DESCRIPTION OF THE DRAWINGS

FIG. 1 is a side elevational view in cross-section showing one embodiment of the instant invention.

FIG. 2 is a top plan view, partially in cross-section and partially cut away showing the instant invention.

FIG. 3 is an exploded perspective view of the housing, housing disc, and strainer discs utilized in one embodiment of the instant invention.

PREFERRED EMBODIMENT OF THE INVENTION

Referring now to the drawings and specifically to FIG. 1 the instant invention is shown generally at 10 mounted within a conventional manhole opening frame 26 which is disposed in concrete surface 28, the manhole opening frame being conventional in construction and not forming a part of this invention. Mounted on top of the instant invention is a conventional manhole frame cover 27. The instant invention 10 includes a plastic cylindrical housing 14 and an annular metallic steel rim 11, having a portion of the rim embedded in the cylindrical housing 14 and an annular lip **11*a* which engages the lower lip of the manhole opening 26. The manhole cover 27**, when in position, firmly holds the instant invention in the manhole opening.

Connected to the housing 14 is an upper disc-shaped strainer 12 having support braces which span the diameter of the housing 14, the braces being attached to a rigid centrally mounted disc-shaped 15 forming a pan-like receptacle between the housing cylindrical walls and the interior mid portion of the housing 14. A lower strainer plate 25 is affixed near the bottom, inside of the housing 14.

Coupled to the rigid plate 15 is an upper hinged valve 16 and a lower hinged valve 19 which regulate gaseous fluid flow through plate 15, the plate having passages including a central passage 17 and a plurality of circularly disposed passages 13 disposed around the outside periphery of central passage 17.

The upper valve 16 includes a valve body **16*a* that is pivotally connected by hinge 18 to the upper surface of plate 15. Affixed at the free end of the valve body 16*a* is a weight 39. The passages 13 are covered at the upper ends by the valve body 16*a*. Circular gaskets 12 are mounted on gasket supports 15*a* for sealing passages 13 when the valve body 16 in conjunction with the effect of weight 39 holds the body 16*a* in the closed position as shown in FIG. 1. The upper valve body 16 includes a central aperture 37 which is in communication with passage 17 through the housing disc plate 15. The function of the upper valve body central aperture 37 is to allow atmospheric flow through passage 17 whenever lower valve 19 is open. Pressure above atmospheric within the system evidenced through passage 13 at a predetermined level will cause the hinged valve body 16 to be raised, allowing the gases to escape from the system to reduce the pressure to approximately atmospheric. The particular pressure differential value between system and atmospheric that actuates the flapper valves can be determined by the amount of weight 39 in conjunction with the valve body 16 and length of the moment arm connected to hinge 18. In the closed position, as shown, the upper and lower valves prevent liquid flow through passages 13 and 17** from runoff waters received into the device itself.

The lower valve 19 includes a valve body **19*a* which is pivotally connected by hinge 29 to the lower side of the central disc 15. A gasket 21 which seals the opening through passage 17 is mounted on the upper surface of valve body 19*a* and contacts passage 17 perimeter 20. The valve 19 includes counterbalanced weight 24 connected on the underside of the valve body which acts to hold the valve in the closed position as shown in FIG. 1**. Upon a pre-determined vacuum pressure being achieved within the manhole system, the lower valve will open against the counterweight, permitting atmospheric fluid to flow into the system.

FIG. 2 shows the central plate 15 and the plurality of passages 13 disposed around a central passage 17. In this view a portion of the upper valve body has been removed. The circular inner and outer gaskets 12 are shown mounted in the gasket support. FIG. 3 shows the housing of the instant invention which includes a cylindrical wall 14 having central plate 15 with the upper flapper valve 16. The upper strainer 12 has a plurality of holes or apertures **12*a*** that are sized to prevent undesirable materials from being received into the sewer system or the valve mechanism but to permit gas flow freely through.

The instant invention has been shown and described herein in what is considered to be the most practical and preferred embodiment. It is recognized however, that departures may be made therefrom within the scope of the invention and that obvious modifications will occur to a person skilled in the art.

What I claim is:

1. A gaseous pressure compensating manhole closure for diverting runoff water away from a sewer system adapted to be mounted in a conventional manhole opening frame with the conventional manhole cover mounted therein, the device comprising:

a cylindrical housing;

a rigid plate disposed in said housing forming a receiving upper chamber;

a pressure relief valve means coupled to said plate to allow fluid communication through said plate;

an annular supporting rim attached to said housing sized to be received mounted about the manhole opening frame perimeter.

2. A manhole closure as in claim 1, wherein:

said pressure relief valve means includes an upper flapper valve connected to said rigid plate, a lower flapper valve connected to said rigid plate, said plate having a first passage in fluid communication with said upper valve and a second passage in fluid communication with said lower valve.

3. A pressure compensating manhole closure as in claim 2, including:

a first fluid strainer mounted near the top of said housing; and a second fluid strainer mounted near the bottom of said housing.

4. A pressure compensating manhole closure as in claim 2, wherein:

said upper flapper valve is pivotally connected to said rigid plate, a first weight attached to said upper valve whereby fluid pressure within first passage in said rigid plate will raise said flapper valve at a pre-determined pressure differential as a function of said first weight.

5. A pressure compensating manhole closure as in claim 4, including:

a second weight connected to said lower valve, whereby said fluid pressure in said second passage through said rigid plate in fluid communication with said second lower valve will open said second lower valve as a function of said second weight at a pre-determined pressure differential.

6. A pressure compensating manhole closure as in claim 5, wherein:

said upper valve includes an aperture disposed therethrough, said upper valve aperture being in fluid communication with said second fluid passage whereby said lower valve can open to allow fluid communication between said sewer system and the atmosphere while said upper valve is in a closed position.

7. A pressure compensating manhole closure as in claim 6, wherein:

said cylindrical housing being constructed of a plastic material, and said supporting rim having a portion embedded in said cylindrical housing is constructed of a metallic material.

8. A pressure-compensating manhole closure as in claim 7, including:

a first gasket connected around said first passage in said plate and in a sealing relationship with said upper valve.

9. A pressure compensating manhole closure as in claim 8, including:

a second sealing gasket connected to the upper side of said lower valve in sealing relationship with said second passage through said rigid plate for sealing said second passage when said lower valve is closed.

* * * * *